US007025069B2

(12) United States Patent
Thiebaut

(10) Patent No.: US 7,025,069 B2
(45) Date of Patent: Apr. 11, 2006

(54) DEVICE FOR THE APPLICATION OF A HAIR PRODUCT TO SECTIONS OF HAIR

(75) Inventor: Laure Thiebaut, Clichy (FR)

(73) Assignee: L'Oreal, Paris (FR)

( * ) Notice: Subject to any disclaimer, the term of this patent is extended or adjusted under 35 U.S.C. 154(b) by 223 days.

(21) Appl. No.: 10/192,704

(22) Filed: Jul. 11, 2002

(65) Prior Publication Data

US 2003/0024544 A1 Feb. 6, 2003

(30) Foreign Application Priority Data

Jul. 11, 2001 (FR) ..... 01 09234

(51) Int. Cl.
*A45D 19/18* (2006.01)
*A46B 11/00* (2006.01)
*A46B 15/00* (2006.01)

(52) U.S. Cl. ..... 132/270; 401/10; 401/9

(58) Field of Classification Search ..... 132/270, 132/208, 212, 109, 112, 132, 135, 144, 148, 132/150, 162, 221; 401/9–10, 126, 130, 401/191

See application file for complete search history.

(56) References Cited

U.S. PATENT DOCUMENTS 2,463,611 A * 3/1949 Green et al. ..... 132/108
2,623,228 A * 12/1952 Sherry ..... 401/130
2,705,499 A * 4/1955 Breeze ..... 132/109
2,922,425 A * 1/1960 Lerner et al. ..... 132/212
3,030,968 A 4/1962 Oberstar et al.
3,105,501 A * 10/1963 Scotti ..... 132/212
3,221,359 A * 12/1965 Moroni et al. ..... 401/130
3,450,140 A * 6/1969 Vail ..... 132/212
3,608,565 A * 9/1971 Ensign ..... 132/212
3,871,390 A * 3/1975 Spatz ..... 132/293
4,671,302 A * 6/1987 Hill ..... 132/212
4,691,720 A 9/1987 Schmitz
4,830,030 A * 5/1989 Busch et al. ..... 132/212
5,146,936 A 9/1992 Ng
5,301,697 A * 4/1994 Gueret ..... 132/298
5,348,031 A * 9/1994 Cloud ..... 132/317
5,704,088 A * 1/1998 Cerroni ..... 15/160
6,062,231 A * 5/2000 De Laforcade ..... 132/145
6,250,312 B1 * 6/2001 Dasilva ..... 132/208
6,676,321 B1 * 1/2004 Gueret ..... 401/130
2002/0038661 A1 * 4/2002 Gueret ..... 132/320

FOREIGN PATENT DOCUMENTS

EP 1106101 6/2001

* cited by examiner

*Primary Examiner*—John J. Wilson
*Assistant Examiner*—Robyn Doan
(74) *Attorney, Agent, or Firm*—Oblon, Spivak, McClelland, Maier & Neustadt, P.C.

(57) ABSTRACT

A device for applying a hair product to sections of hair includes a first part having an open cavity to contain the hair product. The product is applied to the section of hair by contacting the section of hair with the product inside the cavity and moving the device relative to the section of hair. The device also includes a second part having a retention member that is movable relative to the cavity to selectively open and close the cavity. When closed, the retention member keeps the section of hair in contact with the product inside the cavity as the device moves relative to the section of hair. The retention member preferably includes a porous and/or fibrous element that can absorb or in other words be impregnated with the hair product.

71 Claims, 3 Drawing Sheets

DEVICE FOR THE APPLICATION OF A HAIR PRODUCT TO SECTIONS OF HAIR

CROSS REFERENCE TO RELATED APPLICATIONS

This document claims priority to French application number 0109234 filed Jul. 11, 2001, the entire content of which is hereby incorporated by reference.

BACKGROUND OF THE INVENTION

1. Field of the Invention

The present invention relates to a device for the application of a hair product to sections of hair. The invention is particularly suitable for the application of a dye product to sections of hair.

2. Discussion of Background

There are a number of types of hair dye products: temporary dyes, semi-permanent dyes, and permanent or oxidation dyes. These dye products can be provided in the form of a cream, a foam, or a liquid of greater or lesser viscosity. Dye products in liquid or gel form can be used after mixing, if necessary, from a pan or from a bowl.

Dyes used from a bowl can be applied to the entire head of hair, with all of the hair impregnated with the product, and with the aim being to modify the color of the entire head of hair. Alternately, dyes can be applied to sections of hair, where only certain parts of the hair are soaked with the product in order to produce a non-homogeneous color effect once the treatment is completed, thereby highlighting the hair with lighter or darker shades of color than the natural or overall shade of the hair.

One known technique for applying a product to sections of hair uses a dyeing cap which tightly fits over the hair. With this technique, sections of hair are pulled out of the cap through holes distributed regularly over the surface of the cap using a hook-type device. The dye product is then applied to these extracted sections of hair in the same manner as for all-over dyeing. The product is usually applied with a brush. After the treatment is complete, the dyeing cap is removed and the colored hair resumes its natural position.

The dyeing cap technique is very tedious and has at least three major drawbacks. Specifically, after the cap is put on, the hair is flattened and the sections of hair are randomly extracted through the holes which can lead to a result, particularly in terms of the distribution of the sections of hair, which is quite different from the intended result. Furthermore, the size of the extracted sections of hair is proportional to the diameter of the holes in the cap. As this diameter is usually small (typically about 1 mm to 2 mm), there is poor juxtaposition of the sections of hair. In addition, due to the thickness of the cap and the thickness of the sections of hair, and because the extracted hair is not necessarily the hair whose connection to the scalp is directly beneath the hole through which it is extracted, the dye product deposited by this technique clearly does not go to the roots of the hair, thereby detracting from the natural appearance of the result.

To mitigate these inadequacies, a variety of application devices have been devised. Generally, these application devices are based either on a comb or on a brush, or on a combination of the two. Such devices are disclosed, for example, in U.S. Pat. Nos. 5,146,936 and 4,691,720. Such devices generally suffer from the same drawbacks as described above relating particularly to the fact that they are used by approaching the hair from the exterior or top of the hair. As a result, most of the product is deposited on the outer surfaces of the section of hair, with very little penetrating interiorly. After the applicator initially contacts the exterior or outer surface of the hair, the applicator is then moved relative to the section of hair from the root to the tip. Experience shows that during this movement the user tends to lift the applicator so that it departs from a trajectory parallel to the curvature of the scalp. As a result, several hairs become detached from the applicator and fall back onto the head. In the case of a dye product, these hairs will therefore not be dyed. The result obtained is therefore far from satisfactory.

Another type of applicator for sections of hair is disclosed in U.S. Pat. No. 3,030,968. This device is a U-shaped tong system having an open reservoir at the end of one of the arms of the U. A rigid applicator (which may be made of metal, glass or plastic) is provided at the end of the other arm of the U. With this arrangement, the section of hair to be colored is placed in the reservoir containing the dye product, and the hair is held in position with the aid of the rigid applicator which fits into the reservoir in such a way as to soak the section of hair in the liquid. The system is then moved all the way along the section of hair from the root. Such an applicator requires the reservoir to be relatively full in order for the entire section of hair to be dipped in the product and completely coated. Moreover, with such a configuration there is a danger that the product will drip out of the reservoir during application. Also, the rigid applicator which keeps the section of hair in the reservoir tends to scrape the product away as the system moves so that one side of the section of hair is not soaked with the product. Finally, such a device requires the section of hair to be treated to be picked out with the fingers or with a supplementary device.

SUMMARY OF THE INVENTION

It is an object of the invention to provide a device for applying a hair product to sections of hair while avoiding or minimizing the drawbacks discussed above.

It is another object of the invention to provide a user-friendly applicator device which provides a cavity for the hair product and which prevents or minimizes the inadvertent escape or spillage of the product from the cavity during use.

It is a further object of the invention to provide a device that simplifies a hair dyeing operating and that can perform all of the steps necessary for a dyeing operation.

Another object of the invention is to provide a device capable of applying product to all of the hair within a desired section of the hair.

The above and additional objects and advantages are achieved in accordance with the invention by providing a device for the application a hair product to hair sections, in which a first part has an open cavity containing the product. The product is applied to the section of hair by contacting the section of hair with the product inside of the cavity and moving the device relative to the section of hair. The device also includes a second part having a retention member, with the first and second parts movable relative to each other to allow the retention member and cavity to be opened and closed with respect to each other. When closed, the retention member is able to keep the section of hair in contact with the product inside the cavity as the device moves relative to the section of hair. Preferably, the retention member includes a porous and/or fibrous element. When open, dye or another hair product can be placed in the cavity, and the hair section can be inserted.

With the arrangement of the invention, the porous and/or fibrous element can absorb product from the cavity, into its pores or between the fibres, and then release the product onto the section of hair as the device moves relative to the section of hair. This enables the entire section of hair to be coated, particularly the hair in contact with the retention member. In addition, the entire section of hair is impregnated with the product without requiring the cavity to be completely full, so that the risk of the product dripping out of the cavity can be further reduced.

In a preferred form, the retention member is designed to fit inside the cavity, and can be formed entirely of a porous and/or fibrous material, or of an element covered with a layer of porous and/or fibrous material.

In an advantageous exemplary embodiment, the retention member is elastically deformable and preferably compressible. As a result, the friction generated by the retention member as the device moves relative to the section of hair is limited. The retention member can thus release or apply the product onto one side of the section of hair without scraping it off.

In a preferred embodiment, the porous and/or fibrous element includes at least one block of an open-cell or semi-open-cell foam material, a flexible frit, a brush of bristles. Other materials are also possible such as a fabric or other fibrous materials. By way of example, the retention member can include a foam of at least one material selected from the group of elastomers: propylene/ethylene copolymers; polyether-block-amides; polyvinyls; ethylene-propylene-diene terpolymers (EPDM); styrene-butadiene-styrene block polymers (SBS); styrene-ethylene-butylenestyrene/styrene-isoprene-styrene block polymers (SEBS-SIS); thermoplastic polyurethanes; blends of polypropylene with one of the following elastomers: styrene-ethylene-butylene-styrene/styrene-isoprene-styrene block copolymers (SEBS-SIS); ethylene-propylene-diene terpolymers (EPDM); styrene-butadiene-styrene block copolymers (SBS). When provided in the form of a bristle brush, very fine bristles with a diameter of about 0.1 to 0.3 mm are preferred.

Preferably in accordance with an advantageous aspect of the invention, the retention member defines a volume, particularly when not under stress (or compressed), which is less than the volume defined by the cavity. Thus, when the retention member is placed inside the cavity, it does not cause the product to spill out of the cavity.

In one particular embodiment of the invention, the cavity is bounded by an internal wall at least partly covered by a porous and/or fibrous element. The product is thus absorbed into the pores or between the fibres and is therefore held in the cavity. This arrangement is particulary advantageous when using a liquid product.

Advantageously, two parts of the applicator are able to pivot about an axis in such a way that the retention member fits inside of the cavity in one position and leaves the cavity open in a second position. The cavity is formed at a first end of the first part, while the retention member is formed at a first end of the second part. In addition, the second end of the first part and the second end of the second part preferably form handles for holding the device. In this way the user can easily hold the device and pivot the two parts with respect to each other in order to take the retention member out of the cavity to place the section of hair in it, and then to insert the retention member into the cavity so that the section of hair is held therein.

The two elongate parts can be made as one piece forming, for example, a U-shaped tong type device, or the parts can be separate.

To make the device easier to hold, each of the two ends that form handles may, for example, terminate in a ring. Advantageously, a spring can be mounted on the two parts so as to hold the retention member in the cavity.

In another embodiment of the invention, the cavity is bounded by a wall with a free edge defining an opening across essentially its entire cross section. The product can thus be picked up directly in the cavity by using it like a spoon. Optionally, the cavity can be open across only part of its cross section.

According to another advantageous feature, the first part has a main axis X, and the cavity is optionally mounted on the first part such that the cavity is off-center with respect to the axis X, with a large part of the cavity preferably situated to one side of the axis. It is therefore easy to scoop up product from another container by introducing the larger part of the cavity situated on one side of the axis X, without being hampered by other parts of the device lying in the axis X. The cavity may for example be in the form of a hemisphere or have an elliptical cross section.

The wall bounding the cavity preferably includes at least one notch designed to receive and hold the section of hair in position in the cavity throughout the relative movement of the device with respect to the section of hair. The wall bounding the cavity preferably includes two notches, each positioned on the free edge of the cavity, preferably along the axis of movement of the system during application of the product.

In another embodiment of the invention, the device can include an arrangement for isolating a section of hair from the rest of the hair before the section of hair is treated. By way of example, this arrangement can include a hook, positioned, for example, adjacent to the cavity, in the axis X of the first part.

Each of the two parts is preferably molded as one piece from a thermoplastic material, such as polypropylene or polyethylene.

In addition to the arrangements described above, the invention can include a number of other arrangements and advantageous aspects which are explained below.

BRIEF DESCRIPTION OF THE DRAWINGS

A better appreciation of the invention and many of the attendant advantages thereof will become further apparent from the following detailed description, particularly when read in conjunction with the accompanying drawings of which.

DETAILED DESCRIPTION OF THE PREFERRED EMBODIMENTS

Figure 1:
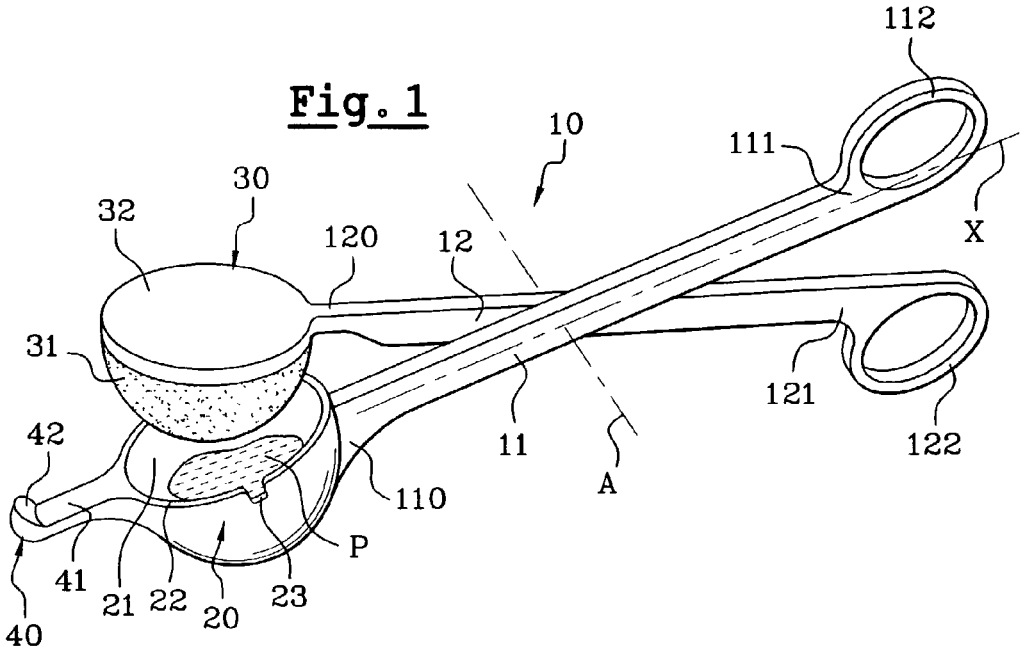
FIG. 1 is a side perspective view of a first embodiment of the application device according to the invention.
Figure 2:
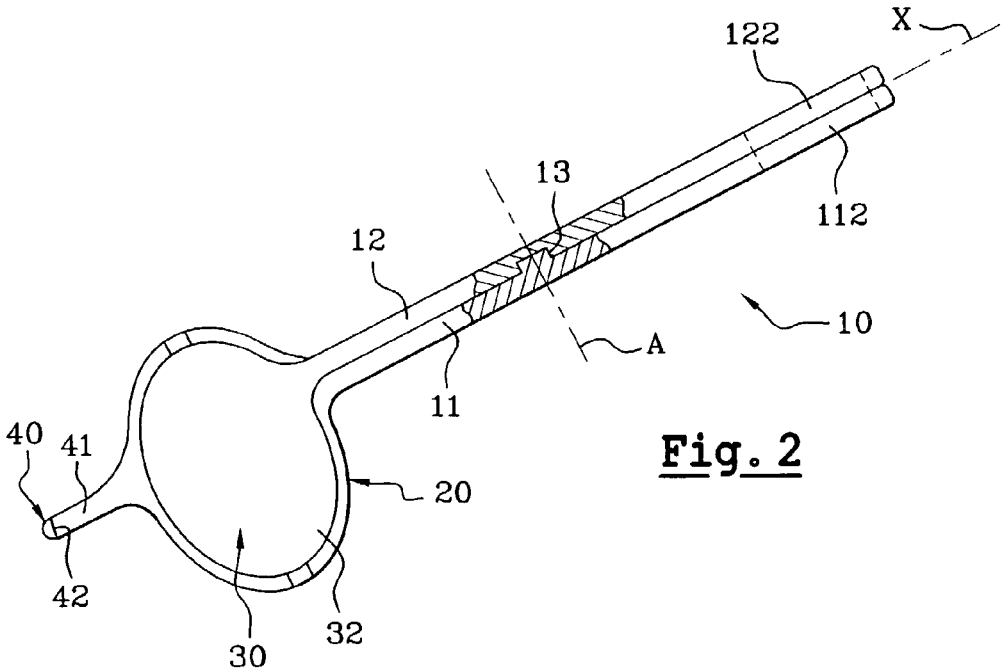
FIG. 2 is an axial cross section through the device illustrated in FIG. 1.

FIGS. 1 to 3 depict a first embodiment of the device 10 for the application of a hair product to sections of hair of a hair product. The device 10 includes two arms 11 and 12 hinged to each other so as to be able to pivot about an axis A. In the preferred form illustrated, the two arms are of approximately the same length. By way of example, the arms can be snap-fitted together utilizing a projection 13 on one of the arms which fits into an orifice on the other arm so as to provide a pivot coupling about the axis A similar to that utilized in a pair of scissors. As an alternative, the two arms may be riveted together or coupled by other fastening expedients to provide a hinge or pivot coupling. Each arm is preferably formed as a single molded piece, and the arms are then fitted together. It is to be understood, however, that it is also possible to form the arms of multiple pieces. The two arms are preferably made from a thermoplastic material such as a polyolefin. According to one of the advantageous aspects of the invention, the arms are preferably formed of different materials so as to limit the friction between the hinged parts during rotation. The first arm may, for example, be made of polypropylene and the second of polyethylene.

The first arm 11 has a main axis X, with a cavity 20 disposed at a first end 110 of the first arm 11. The cavity 20 is bounded by a wall with a free edge 21 that defines an opening 22 across essentially the entire cross section of the cavity. The cavity 20 has an elliptical cross section in the illustrated example, and this section diminishes towards the bottom of the cavity. The wall bounding the cavity 20 is provided on its free edge 21 with two notches 23. Preferably, the notches are disposed on an axis perpendicular to the axis X. These notches 23 are used, as will be seen in greater detail below, to hold a section of hair in a particular position in the cavity during application of the dye product. The wall bounding the cavity 20 is made of polypropylene and can be advantageously produced during molding of the first arm 11.

The second arm 12 has a retention member 30 disposed at its first end 120. The retention member includes a block of foam 31 having an elliptical cross section. This is fixed, for example, by adhesive bonding or any other appropriate fixing means, to a disc 32 formed in the extension of the second arm 12. Once again, the disc 32 is made of polyethylene and is produced during the molding of the second arm. The block of foam is shaped in such a way that it can fit into the cavity 20 through the opening 22 so as to soak a section of hair in the dye product P. The retention member thus includes a protruding portion that protrudes into the cavity when the retention member is moved toward the cavity to close the cavity. A block of low-density open-cell foam such as a crosslinked foam of polyester-based polyurethane, can be used for the foam block. A foam compatible with the dye product that is to be applied is preferred. Although various shapes and relative orientations are depicted in the preferred forms of the invention illustrated herein, it is to be understood that the shapes and specific positions of various components can be varied in accordance with the invention. For example, although an ellipitcal cross-section is preferred for the cavity and retention member, other shapes are also possible including, for example, a round or hemispherical shape. Preferably, the retention member and the foam block have the same or a similar shape as the cavity to provide a good mating relationship between the two. However, the retention member and/or foam block need not exactly match the cavity in shape. For example, the retention member 30 could have a shape different from the cavity opening, but preferably, the retention member will cover the cavity when in a closed position to prevent or minimize spillage. Also, although it is preferred to orient the notches perpendicular to the axis X, other orientations are possible, and the arms could be of various shapes such that an axis might not extend through the entire or substantially the entire length of one or both of the arms. In addition, although a foam block is illustrated, as discussed earlier, other materials are also possible such as fibrous bristle or fabric materials.

In a variant (not shown) of the above embodiment, the second arm 12 ends not in a simple disc but in an element of convex shape molded as one piece with the rest of the second arm. This convex element is covered with a layer of foam or bristles or other material.

The two arms can pivot about the axis A, which is perpendicular to the axis X of the first arm, in such a way that in a first position, the block of foam fits inside the cavity 20 and, in a second position, the block of foam is disposed outside of the opening 22 of the cavity 20. In this second position, the block of foam is at a sufficient distance from the opening 22 of the cavity for the cavity to be able to be used to scoop up product from another container so that the arm and cavity can be used like a spoon.

The retention member 30 advantageously defines a volume which is less than the volume of the cavity 20 so that when the block of foam 31 is inside the cavity, it can become impregnated with product without causing the product to spill out of the cavity. Alternatively, or in addition, the bottom of the cavity 20 may be covered with a porous or fibrous material capable of retaining the product in the cavity, particularly when a liquid product is used. In this way the product is held in the cavity and can be released onto a section of hair when the section of hair is placed in the cavity and held in position by the retention member 30. Also advantageously, the retention member 30 can close the opening 22 of the cavity in a more or less leaktight manner, so as to prevent or minimize product escaping from the cavity during the relative movement of the device with respect to the section of hair. Preferably, the retention member is sized and shaped to at least substantially close the opening of the cavity when the device is in a closed position to hold the section of hair. The amount of leak-tightness could vary, for example, depending upon the product to be used. As should be apparent, the retention member need not entirely close the cavity as, e.g., the notches 23 are not closed by the retention member. However, because the section of hair is disposed in the notches when the retention member is in the closed position, none or only minimal amounts of the product can escape through the notches and the cavity is substantially closed. The retention member need not completely prevent all possible leakage, e.g., as might occur if the device were shaken vigorously, however, the retention member should preferably provide sufficient closure to minimize inadvertent leakage during normal handling and movement of the device associated with a dying or other hair treatment process.

As can be seen in FIG. 2, in the preferred form, the cavity is located on the first arm 11 in such a way that its opening 22 is off-center with respect to the axis X (in other words, the geometric center of the opening is spaced from the axis X or the opening is not symmetrically disposed with respect to the axis X), and the retention member 30 is likewise located off-center with respect to the axis X so as to fit into the cavity.

Each of the arms 11 and 12 ends at its second end 111 and 121 in a ring 112 and 122 to allow the user to hold the device, again in a manner similar to a pair of scissors.

A hook 40 is advantageously situated adjacent to the cavity 20 on an extension of the arm 11. The hook comprises a first elongate portion 41 disposed along the axis X of the arm 11, and the hook ends in a second portion 42 which curves up above the plane defined by the top or mouth opening of the cavity, i.e., the portion of the cavity opening away from the bottom of the cavity. The hook 40 is also made of polypropylene and is produced during the molding of the first arm 11 and of the cavity 20.

The use of the device of the invention will now be described in conjunction with FIGS. 3A to 3D. The device can be used for applying a dye product in the form of a liquid or foam as well as for applying a dye product in the form of a cream. However, the device could also be used for other hair products if desired.

Figure 3A:
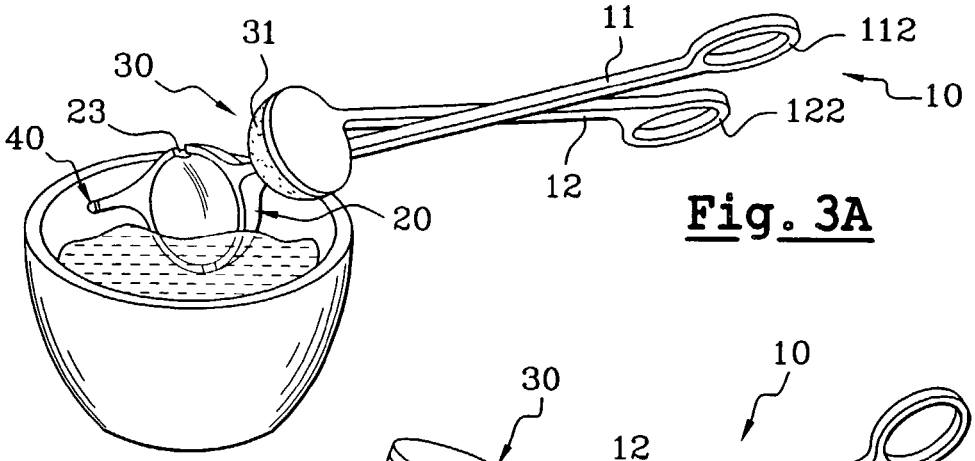
FIGS. 3A to 3D illustrate different stages in the use of the device shown in FIGS. 1 and 2.

First, the user holds the device 10 by means of the rings 112 and 122 in the manner of a pair of scissors. He or she then scoops up a small amount of dye product, keeping the block of foam 31 out of the cavity 20 in order to use the cavity to scoop up the product in the manner of a spoon as illustrated in FIG. 3A. Once the bottom of the cavity contains a certain amount of product, the user dips the block of foam 31 into it to impregnate the block of foam (or other material associated with the retention device). As noted earlier, materials that can be associated with the retention device can vary. However, preferably an impregnatable material is used such as, in addition to a foam or sponge type material, a fibrous material such as a bristle-type material or possibly a fabric. The material is impregnatable, or in other words can hold or absorb the dye, by one or more phenomena such as capillary action, surface tension, wicking, etc. As noted earlier, an impregnatable material such as a foam or porous material, or a fibrous or bristle material can also be associated with the cavity (e.g., disposed on an interior wall of the cavity) in addition to or in lieu of such a material on the retention member.

Figure 3B:
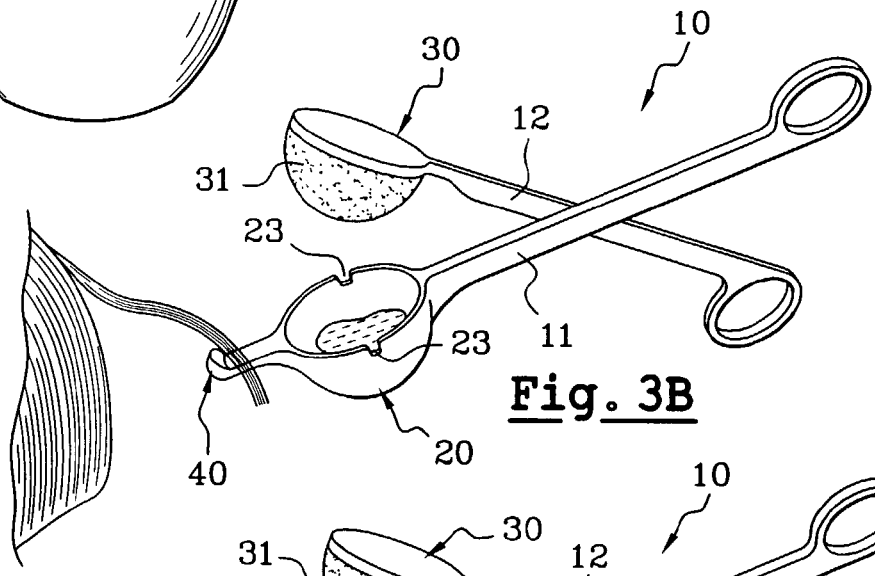
Figure 3C:
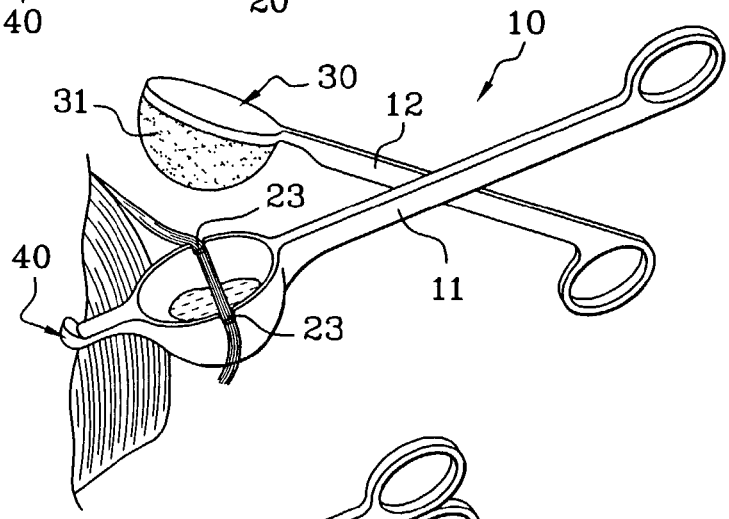

The user can then isolate a section of hair to be dyed by using the hook 40 as shown in FIG. 3B. The user then lays the isolated section of hair in the cavity 20, and in particular, in the notches 23 as shown in FIG. 3C.

Figure 3D:
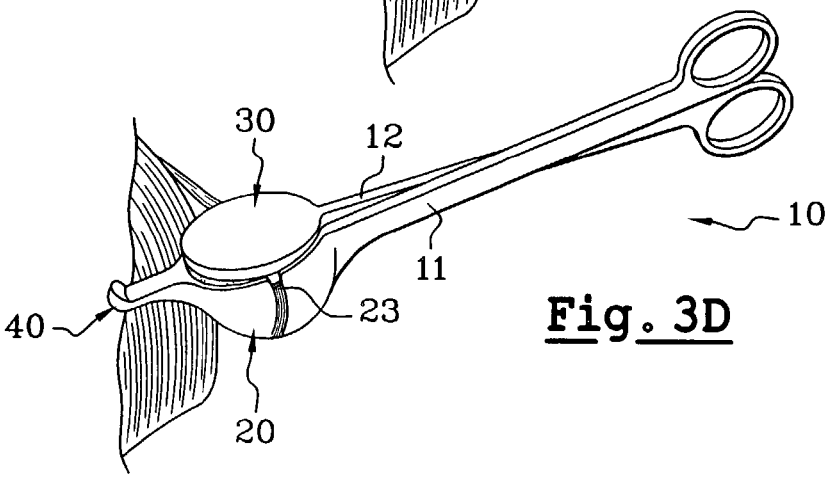

The part of the section of hair that lies between the two notches 23 is pressed into the product contained in the cavity by the block of foam, which is pushed into the cavity as shown in FIG. 3D. The whole device can be moved in this closed position all the way along the section of hair, beginning at the root.

Figure 4:
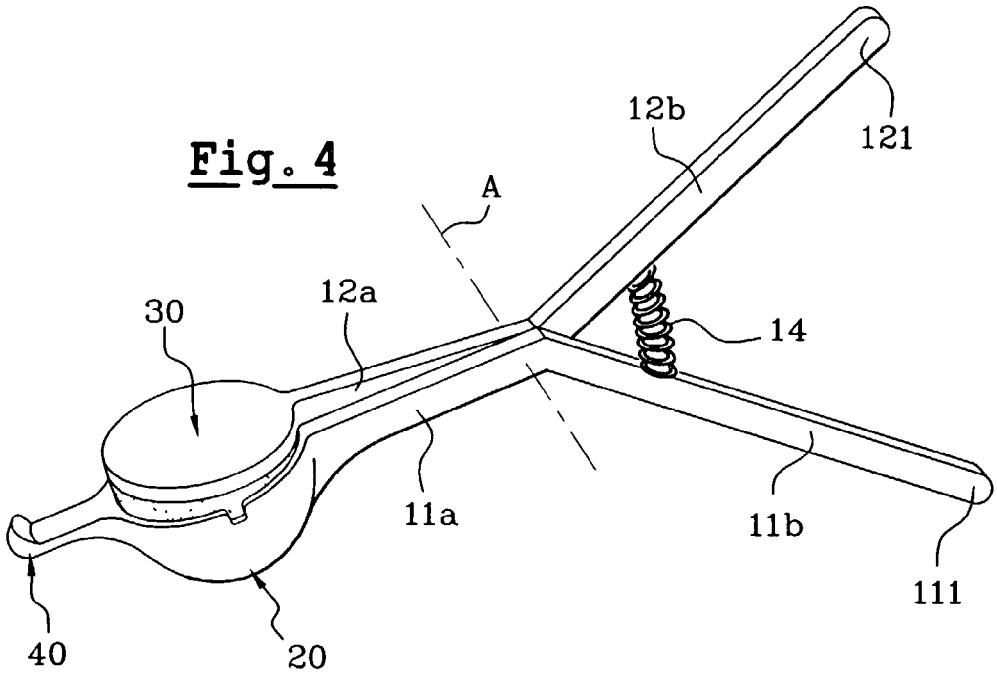
FIG. 4 is a side perspective view of a second embodiment of the application device according to the invention.

The second embodiment shown in FIG. 4 is identical to that described in conformity with FIGS. 1 to 3 as far as the cavity 20 and retention member 30 are concerned. In this embodiment, the arms 11 and 12 have no rings at their ends 111 and 121. Each arm 11 and 12 has two angled portions 11*a*, 11*b* and 12*a*, 12*b*, respectively, situated on either side of the axis of rotation A. The portions 11*b* and 12*b* have respective ends 111 and 121 which act as the handles. When the portions 11*a* and 12*a* are approximately aligned, the portions 11*b* and 12*b* are separated. The portions 11*b* and 12*b* are connected to each other by a spring 14 in the manner of a pair of secateurs. The spring 14 works in compression and is mounted on the arms in such a way that when it is at rest, that is when not compressed by the user, the block of foam 31 is held inside the cavity 20. To remove the block of foam from the cavity, the user squeezes the two ends 111 and 121 of the two portions of the arms 11*b* and 12*b* together so that the spring is compressed.

Figure 5:
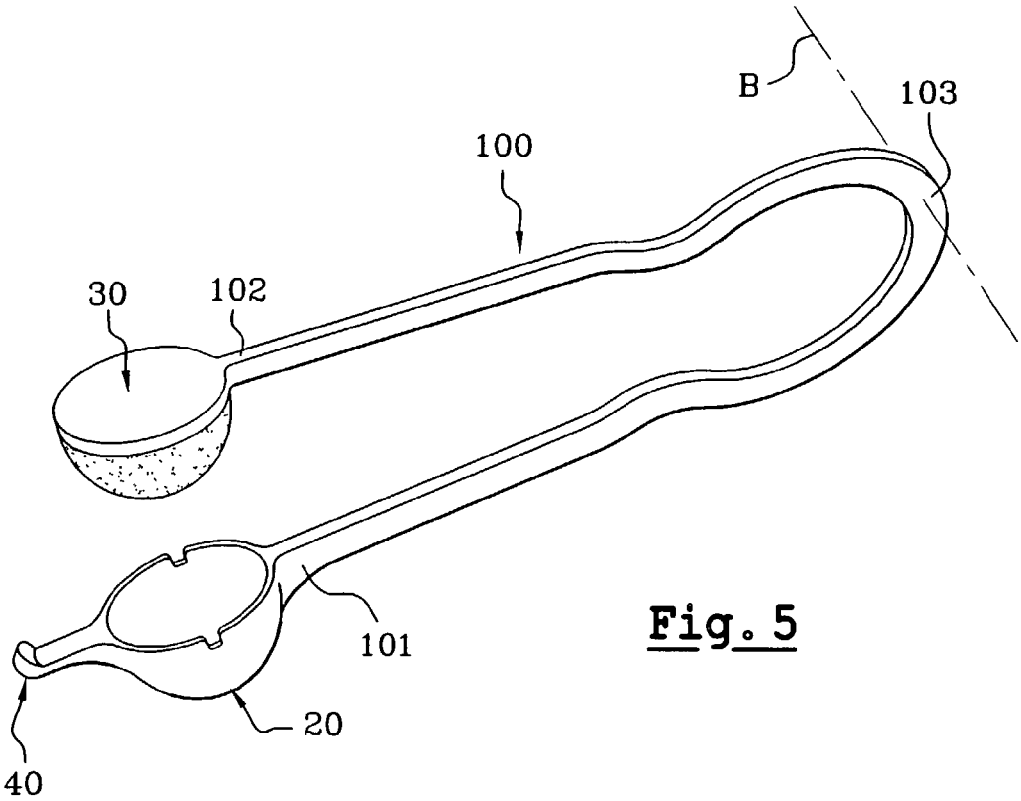
FIG. 5 is a side perspective view of a third embodiment of the application device according to the invention.

The third embodiment shown in FIG. 5 is identical to that described in conformity with FIGS. 1 to 3 as far as the cavity 20 and retention member 30 are concerned, but this time it is made in one piece 100 so as to form U-shaped tongs. One of the free ends 101 of the arms of the U is provided with the cavity 20 and the other of the free ends 102 of the arms of the U is provided with the retention member 30. The two arms of the U pivot about an axis B situated, with this arrangement, at the base 103 of the U. In this embodiment, essentially the entire device can be formed as a single molding (except, e.g., the impregnatable or absorbable material associated with the retention member and/or the cavity).

Obviously, numerous modifications and variations of the present invention are possible in light of the above teachings. It is therefore to be understood that, within the scope of the appended claims, the invention may be practiced otherwise than as specifically described herein.

What is claimed is:

1. A device for applying a hair product to a section of hair comprising:

a first part, said first part including a cavity defining a volume that can contain a hair product such that the hair product can be applied to the section of hair by contacting the section of hair with the hair product disposed in the volume of the cavity and moving the cavity along the section of hair, and wherein the cavity includes an opening;

a second part, said second part including a retention member, and wherein said first and second parts are movable relative to each other such that the retention member can selectively hold the section of hair in contact with the hair product disposed in the volume of the cavity, and further wherein the retention member is at least partially formed of an impregnatable material, and wherein said retention member includes a shape which is substantially the same as a shape of the opening of said cavity;

wherein said retention member has a shape which matches a shape of the volume defined by said cavity, and wherein said first and second parts are movable relative to each other between a first position and a second position, and wherein in said first position said retention member at least partially extends through the opening of the cavity and into the volume of the cavity to substantially close said opening, and wherein in said second position said retention member is spaced from said cavity, and wherein said cavity includes at least one notch that is not closed by a member of said device when said retention member is in said first position so that said notch can receive said section of hair during a relative movement of said cavity with respect to said section of hair.

2. A device as recited in claim 1, wherein the impregnatable material is elastically deformable.

3. A device as recited in claim 2, wherein the impregnatable material includes at least one material selected from the group consisting of a block of an open foam cell material, a semi-open cell foam material, a flexible frit, and a brush of bristles.

4. A device as recited in claim 1, wherein the impregnatable material includes a foam of at least one material selected from the group consisting of propylene/ethylene copolymers; polyether-block-amides; polyvinyls; ethylene-propylene-diene terpolymers (EPDM); styrene-butadiene-styrene block polymers (SBS); styrene-ethylene-butylene-styrene/styrene-isoprene-styrene block polymers (SEBS-SIS); thermoplastic polyurethanes; polypropylene blends with styrene-ethylene-butylenestyrene/styrene-isoprene-styrene block copolymers (SEBS-SIS); polypropylene blends with ethylenepropylene-diene terpolymers (EPDM); and polypropylene blends with styrene-butadiene-styrene block copolymers (SBS).

5. A device as recited in claim 1, wherein the cavity includes an internal wall that is at least partly covered by at least one of a porous element and a fibrous element.

6. A device as recited in claim 1, wherein the first and second parts are pivotable relative to each other to move the first and second parts between the first and second positions.

7. A device as recited in claim 1, wherein the cavity is formed at a first end of the first part, and the retention member is formed at a first end of the second part.

8. A device as recited in claim 7, wherein a second end of the first part and a second end of the second part each includes a handle for holding the device.

9. A device as recited in claim 1, wherein the first and second parts are each one-piece parts.

10. A device as recited in claim 1, wherein the cavity has a hemispherical shape.

11. A device as recited in claim 1, wherein said cavity has an elliptical cross-section.

12. A device as recited in claim 1, wherein the cavity is bounded by a wall with a free edge defining the opening across essentially its entire cross section.

13. A device as recited in claim 1, wherein each of said first and second parts is molded as one piece from at least one thermoplastic material.

14. A device as recited in claim 13, wherein said at least one thermoplastic material includes at least one of polypropylene and polyethylene.

15. A device according to claim 1, wherein said retention member has a domed shape.

16. A device according to claim 15, wherein a periphery of said retention member mates with a periphery of said cavity in said first position to substantially close said cavity.

17. A device according to claim 16, wherein the cavity includes an impregnatable material disposed therein.

18. A device according to claim 1, wherein a periphery of said retention member mates with a periphery of said cavity in said first position to substantially close said cavity.

19. A device according to claim 1, wherein said opening of said cavity has a circular shape and said retention member includes a circular cross-sectional shape.

20. A device according to claim 1, wherein said opening has an elliptical shape and said retention member includes an elliptical cross-sectional shape.

21. A device according to claim 1, wherein said retention member includes a substantially rigid support portion and a protruding portion projecting from said substantially rigid support portion, and wherein said protruding portion is at least partially formed of said impregnatable material.

22. A device according to claim 21, wherein said substantially rigid support portion has a shape which matches the shape of said opening of said cavity, and further wherein said protruding portion includes a shape which matches a shape of the volume defined by the cavity.

23. A device according to claim 1, wherein said first part includes a first arm and said second part includes a second arm, said first and second arms being hinged to each other so as to pivot about an axis, said cavity being located at one side of said first arm relative to said axis and said first arm having a first handle located at another side of said first arm relative to said axis, said retention member being located at one side of said second arm relative to said axis and said second arm having a second handle located at another side of said second arm relative to said axis.

24. A device for applying a hair product to a section of hair comprising:

a first part, said first part including a cavity defining a volume that can contain a hair product such that the hair product can be applied to the section of hair by contacting the section of hair with the hair product disposed in the volume of the cavity and moving the cavity along the section of hair, and wherein the cavity includes an opening;

a second part, said second part including a retention member, and wherein said first and second parts are movable relative to each other such that the retention member can selectively hold the section of hair in contact with the hair product disposed in the volume of the cavity, and further wherein the retention member is at least partially formed of an impregnatable material, and wherein said retention member includes a shape which is substantially the same as a shape of the opening of said cavity;

wherein said retention member has a shape which matches a shape of the volume defined by said cavity, and wherein said first and second parts are movable relative to each other between a first position and a second position, and wherein in said first position said retention member at least partially extends through the opening of the cavity and into the volume of the cavity to substantially close said opening, and wherein in said second position said retention member is spaced from said cavity, wherein the cavity is formed at a first end of the first part, and the retention member is formed at a first end of the second part, a second end of the first part and a second end of the second part each includes a handle for holding the device, and wherein each of the handles includes a ring.

25. A device for applying a hair product to a section of hair comprising:

a first part, said first part including a cavity defining a volume that can contain a hair product such that the hair product can be applied to the section of hair by contacting the section of hair with the hair product disposed in the volume of the cavity and moving the cavity along the section of hair, and wherein the cavity includes an opening;

a second part, said second part including a retention member, and wherein said first and second parts are movable relative to each other such that the retention member can selectively hold the section of hair in contact with the hair product disposed in the volume of the cavity, and further wherein the retention member is at least partially formed of an impregnatable material, and wherein said retention member includes a shape which is substantially the same as a shape of the opening of said cavity;

the device further including a spring mounted between the two parts to bias the two parts in a direction to hold the retention member in a position in which the retention member at least partially extends into the volume of the cavity, and wherein said cavity includes at least one notch that is not closed by a member of said device when said retention member is in said position so that said notch can receive said section of hair during a relative movement of said cavity with respect to said section of hair.

26. A device according to claim 25, wherein said first part includes a first arm and said second part includes a second arm, said first and second arms being hinged to each other so as to pivot about an axis, said cavity being located at one side of said first arm relative to said axis and said first arm having a first handle located at another side of said first arm relative to said axis, said retention member being located at one side of said second arm relative to said axis and said second arm having a second handle located at another side of said second arm relative to said axis.

27. A device for applying a hair product to a section of hair comprising:

a first part, said first part including a cavity defining a volume that can contain a hair product such that the hair product can be applied to the section of hair by contacting the section of hair with the hair product disposed in the volume of the cavity and moving the cavity along the section of hair, and wherein the cavity includes an opening;

a second part, said second part including a retention member, and wherein said first and second parts are movable relative to each other such that the retention member can selectively hold the section of hair in contact with the hair product disposed in the volume of the cavity, and further wherein the retention member is at least partially formed of an impregnatable material, and wherein said retention member includes a shape which is substantially the same as a shape of the opening of said cavity;

wherein said retention member has a shape which matches a shape of the volume defined by said cavity, and wherein said first and second parts are movable relative to each other between a first position and a second position, and wherein in said first position said retention member at least partially extends through the opening of the cavity and into the volume of the cavity to substantially close said opening, and wherein in said second position said retention member is spaced from said cavity, and wherein the first part has a main axis X, and wherein the cavity is positioned on said first part such that said cavity is off-center with respect to the axis X.

28. A device for applying a hair product to a section of hair comprising:

a first part, said first part including a cavity defining a volume that can contain a hair product such that the hair product can be applied to the section of hair by contacting the section of hair with the hair product disposed in the volume of the cavity and moving the cavity along the section of hair, and wherein the cavity includes an opening;

a second part, said second part including a retention member, and wherein said first and second parts are movable relative to each other such that the retention member can selectively hold the section of hair in contact with the hair product disposed in the volume of the cavity, and further wherein the retention member is at least partially formed of an impregnatable material, and wherein said retention member includes a shape which is substantially the same as a shape of the opening of said cavity;

wherein the cavity includes at least one notch that is not closed by a member of said device when said device is in a closed position where said retention member can hold said section of hair so that said notch can receive the section of hair and hold it in position in the cavity during relative movement of said device with respect to said section of hair.

29. A device according to claim 28, wherein said first part includes a first arm and said second part includes a second arm, said first and second arms being hinged to each other so as to pivot about an axis, said cavity being located at one side of said first arm relative to said axis and said first arm having a first handle located at another side of said first arm relative to said axis, said retention member being located at one side of said second arm relative to said axis and said second arm having a second handle located at another side of said second arm relative to said axis.

30. A device for applying a hair product to a section of hair comprising:

a first part, said first part including a cavity defining a volume that can contain a hair product such that the hair product can be applied to the section of hair by contacting the section of hair with the hair product disposed in the volume of the cavity and moving the cavity along the section of hair, and wherein the cavity includes an opening;

a second part, said second part including a retention member, and wherein said first and second parts are movable relative to each other such that the retention member can selectively hold the section of hair in contact with the hair product disposed in the volume of the cavity, and further wherein the retention member is at least partially formed of an impregnatable material, and wherein said retention member includes a shape which is substantially the same as a shape of the opening of said cavity; and means for isolating the section of hair from other hair of a head of hair before said section of hair is treated, wherein said retention member has a shape which matches a shape of the volume defined by said cavity, and wherein said first and second parts are movable relative to each other between a first position and a second position, and wherein in said first position said retention member at least partially extends through the opening of the cavity and into the volume of the cavity to substantially close said opening, and wherein in said second position said retention member is spaced from said cavity.

31. A device as recited in claim 30, wherein the means for isolating the section of hair includes a hook.

32. A device as recited in claim 30, wherein said means for isolating the section of hair is disposed adjacent to the cavity.

33. A device for applying a hair product to a section of hair comprising:

a first part, said first part including a cavity defining a volume that can contain a hair product such that the hair product can be applied to the section of hair by contacting the section of hair with the hair product disposed in the volume of the cavity, and wherein said cavity includes an opening;

a second part, said second part including a retention member, and wherein said retention member includes a protruding portion; and wherein said first and second parts are movable relative to each other between a first position and a second position, and wherein in said first position said protruding portion at least partially extends through said opening and into the volume of said cavity to hold a section of hair in said cavity and said retention member substantially closes said opening, and further wherein in said second position said protruding portion is spaced from said cavity;

wherein a periphery of said retention member mates with a periphery of said cavity in said first position to substantially close said cavity, wherein said first part includes a first arm and said second part includes a second arm, said first and second arms being hinged to each other so as to pivot about an axis, said cavity being located at one side of said first arm relative to said axis and said first arm having a first handle located at another side of said first arm relative to said axis, said retention member being located at one side of said second arm relative to said axis and said second arm having a second handle located at another side of said second arm relative to said axis.

34. A device as recited in claim 33, wherein said protruding portion includes an impregnatable material that is impregnatable with said hair product to hold said hair product.

35. A device as recited in claim 34, wherein said impregnatable material includes a fibrous material.

36. A device as recited in claim 34, wherein said impregnatable material includes a plurality of bristles.

37. A device as recited in claim 34, wherein said impregnatable material includes a foam material.

38. A device as recited in claim 33, wherein said first part is formed of a different material than said second part.

39. A device as recited in claim 33, wherein said first and second parts are pivotably mounted with respect to each other.

40. A device as recited in claim 39, further including a spring which biases said first and second parts toward said first position.

41. A device as recited in claim 33, wherein said cavity includes at least one notch extending from a periphery of said opening.

42. A device as recited in claim 33, wherein said cavity includes a pair of notches extending from a periphery of said opening of said cavity.

43. A device as recited in claim 42, wherein said pair of notches are disposed at substantially opposite sides of said periphery of said opening of said cavity.

44. A device as recited in claim 33, further including an extension extending from a location adjacent to said cavity to assist in separating the section of hair from a head of hair.

45. A device as recited in claim 44, wherein said extension includes a hook.

46. A device as recited in claim 33, wherein said first arm includes a first end at which said cavity is disposed and a second end having said first handle, and further wherein said second arm includes a first end at which said retention member is disposed and a second end having said second handle.

47. A device as recited in claim 33, wherein at least part of said protruding portion is compressible.

48. A device as recited in claim 47, wherein a volume of said protruding part in an uncompressed state is less than a volume of said cavity.

49. A device as recited in claim 33, further including an impregnatable material that can be impregnated with said hair product, wherein said impregnatable material is disposed in said cavity.

50. A device as recited in claim 49, wherein said impregnatable material includes at least one of a porous material and a fibrous material.

51. A device as recited in claim 49, wherein said retention member also includes an impregnatable material.

52. A device as recited in claim 51, wherein said impregnatable material of said retention member is provided in said protruding portion.

53. A device as recited in claim 33, wherein said first part includes an axis extending along a length dimension of said first part, and further wherein said cavity is asymmetrically positioned on said first part with respect to said axis.

54. A device according to claim 33, wherein the protruding portion has a shape which matches a shape of the volume defined by said cavity.

55. A device according to claim 54, wherein the protruding portion is at least partially formed of an impregnatable material.

56. A device according to claim 55, wherein an impregnatable material is disposed in said cavity.

57. A device according to claim 33, wherein said retention member includes a substantially rigid support and said protruding portion protrudes therefrom, and wherein said protruding portion is at least partially formed of an impregnatable material.

58. A device according to claim 57, wherein said substantially rigid support portion has a shape which matches a shape of said opening of said cavity, and further wherein said protruding portion includes a shape which matches a shape of the volume defined by the cavity.

59. A device according to claim 33, wherein said cavity includes at least one notch that is not closed by a member of said device when said retention member is in said first position so that said notch can receive said section of hair during a relative movement of said cavity with respect to said section of hair.

60. A device for applying a hair product to a section of hair comprising:

a first part, said first part including a cavity defining a volume that can contain a hair product such that the hair product can be applied to the section of hair by contacting the section of hair with the hair product disposed in the volume of the cavity, and wherein said cavity includes an opening;

a second part, said second part including a retention member, and wherein said retention member includes a protruding portion; and wherein said first and second parts are movable relative to each other between a first position and a second position, and wherein in said first position said protruding portion at least partially extends through said opening and into the volume of said cavity to hold a section of hair in said cavity and said retention member substantially closes said opening, and further wherein in said second position said protruding portion is spaced from said cavity;

wherein the protruding portion has a shape which matches a shape of the volume defined by said cavity;

wherein the protruding portion has a domed shape; and wherein said first part includes a first arm and said second part includes a second arm, said first and second arms being hinged to each other so as to pivot about an axis, said cavity being located at one side of said first arm relative to said axis and said first arm having a first handle located at another side of said first arm relative to said axis, said retention member being located at one side of said second arm relative to said axis and said second arm having a second handle located at another side of said second arm relative to said axis.

61. A device according to claim 60, wherein the protruding portion is at least partially formed of an impregnatable material.

62. A device according to claim 61, wherein an impregnatable material is disposed in said cavity.

63. A device according to claim 60, wherein said cavity includes at least one notch that is not closed by a member of said device when said retention member is in said first position so that said notch can receive said section of hair during a relative movement of said cavity with respect to said section of hair.

64. A device for applying a hair product to a section of hair comprising:

a first part, said first part including a cavity defining a volume that can contain a hair product such that the hair product can be applied to the section of hair by contacting the section of hair with the hair product disposed in the volume of the cavity, and wherein said cavity includes an opening;

a second part, said second part including a retention member, and wherein said retention member includes a protruding portion; and wherein said first and second parts are movable relative to each other between a first position and a second position, and wherein in said first position said protruding portion at least partially extends through said opening and into the volume of said cavity to hold a section of hair in said cavity and said retention member substantially closes said opening, and further wherein in said second position said protruding portion is spaced from said cavity;

wherein said retention member includes a cross-sectional shape which matches a shape of said opening of said cavity, and further wherein said protruding portion has a shape which matches a shape of the volume defined by said cavity, and wherein said cavity includes at least one notch that is not closed by a member of said device when said retention member is in said first position so that said notch can receive said section of hair.

65. A device for applying a hair product to a section of hair comprising:

a first part, said first part including a cavity defining a volume that can contain a hair product such that the hair product can be applied to the section of hair by contacting the section of hair with the hair product disposed in the volume of the cavity and moving the cavity along the section of hair, and wherein the cavity includes an opening, and further wherein an impregnatable material is positioned inside of said cavity;

a second part, said second part including a retention member, and wherein said first and second parts are movable relative to each other such that the retention member can selectively hold the section of hair in contact with the hair product disposed in the volume of the cavity, and further wherein the retention member is at least partially formed of an impregnatable material;

wherein said retention member has a shape which matches a shape of the volume defined by said cavity, and wherein said first and second parts are movable relative to each other between a first position and a second position, and wherein in said first position said retention member at least partially extends through the opening of the cavity and into the volume of the cavity, and wherein in said first position said retention member substantially closes said opening of said cavity, and further wherein in said second position said retention member is spaced from said cavity, and wherein said first part includes a first arm and said second part includes a second arm, said first and second arms being hinged to each other so as to pivot about an axis, said cavity being located at one side of said first arm relative to said axis and said first arm having a first handle located at another side of said first arm relative to said axis, said retention member being located at one side of said second arm relative to said axis and said second arm having a second handle located at another side of said second arm relative to said axis.

66. A device according to claim 65, wherein said retention member has a domed shape.

67. A device according to claim 66, wherein a periphery of said retention member mates with a periphery of said cavity in said first position to substantially close said cavity.

68. A device according to claim 65, wherein a periphery of said retention member mates with a periphery of said cavity to substantially close said cavity.

69. A device according to claim 65, wherein said retention member includes a substantially rigid support portion and a protruding portion projecting from said substantially rigid support portion, and wherein said protruding portion is at least partially formed of said impregnatable material.

70. A device according to claim 69, wherein said substantially rigid support portion has a shape which matches the shape of said opening of said cavity, and further wherein said protruding portion has a shape which matches a shape of the volume defined by the cavity.

71. A device according to claim 65, wherein said cavity includes at least one notch that is not closed by a member of said device when said retention member is in said first position so that said notch can receive said section of hair during a relative movement of said cavity with respect to said section of hair.

* * * * *